US011269275B2

(12) United States Patent
Koehler et al.

(10) Patent No.: US 11,269,275 B2
(45) Date of Patent: Mar. 8, 2022

(54) SEQUENCING AND STACKING GROUP SELECTION FOR HEATING COMPONENTS

(71) Applicant: Hewlett-Packard Development Company, L.P., Spring, TX (US)

(72) Inventors: Duane A Koehler, Vancouver, WA (US); Robert Yraceburu, Vancouver, WA (US); Francisco Alcazar, Vancouver, WA (US); Vladislav Shapoval, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/733,796

(22) PCT Filed: Aug. 31, 2018

(86) PCT No.: PCT/US2018/049247

§ 371 (c)(1),
(2) Date: Oct. 28, 2020

(87) PCT Pub. No.: WO2020/046395

PCT Pub. Date: Mar. 5, 2020

(65) Prior Publication Data

US 2021/0232070 A1 Jul. 29, 2021

(51) Int. Cl.
*G03G 15/20* (2006.01)

(52) U.S. Cl.
CPC ..... *G03G 15/205* (2013.01); *G03G 15/2007* (2013.01); *G03G 15/2053* (2013.01); *G03G 15/2064* (2013.01)

(58) Field of Classification Search
CPC ... G03G 15/50; G03G 15/205; G03G 15/5004
See application file for complete search history.

(56) References Cited

U.S. PATENT DOCUMENTS

| | | | |
|---|---|---|---|
| 5,789,723 | A | 8/1998 | Hirst |
| 6,011,939 | A | 1/2000 | Martin |
| 6,359,266 | B2 | 3/2002 | Little et al. |
| 7,598,476 | B2 | 10/2009 | Chae et al. |
| 2005/0028017 | A1 | 2/2005 | Janakiraman et al. |
| 2007/0064027 | A1 | 3/2007 | Seo |
| 2007/0212103 | A1 | 9/2007 | Kikuchi |
| 2011/0286778 | A1 | 11/2011 | Kwarta |

(Continued)

*Primary Examiner* — Thomas S Giampaolo, II
(74) *Attorney, Agent, or Firm* — Mannava & Kang

(57) ABSTRACT

According to examples, an apparatus may include a processor and a nontransitory computer readable medium storing machine readable instructions that when executed by the processor may cause the processor to receive a requested power demand from a first heating component and a second heating component, compare the requested power demand to a first threshold, and select a sequencing and stacking group of a plurality of sequencing and stacking groups for the first heating component and the second heating component corresponding to a result of the requested power demand being compared to the first threshold. The instructions may also cause the processor to control application of power to the first heating component and the second heating component according to the selected sequencing and stacking group.

13 Claims, 8 Drawing Sheets

(56) References Cited

U.S. PATENT DOCUMENTS

| | | | | |
|---|---|---|---|---|
| 2015/0185671 | A1* | 7/2015 | Ikebuchi ..... | G03G 15/205<br>399/69 |
| 2016/0149482 | A1 | 5/2016 | Criminale | |
| 2017/0261892 | A1 | 9/2017 | Aoki et al. | |

* cited by examiner

SEQUENCING AND STACKING GROUP SELECTION FOR HEATING COMPONENTS

BACKGROUND

Printing images or text on printable media in a printer includes various media processing activities, including pick-up, delivery to a print engine, printing, and conditioning of sheets of printable media. Conditioning may involve heating and pressing the sheets through or past a heated conveying component, such as a heated pressure roller (HPR), to remove liquid (for printers using liquid ink), to remove wrinkles or curvature, and/or to reform or flatten fibers in the sheets. Other examples of conditioners may include a resistive heating element and a heating lamp.

BRIEF DESCRIPTION OF DRAWINGS

Features of the present disclosure are illustrated by way of example and not limited in the following figure(s), in which like numerals indicate like elements, in which.

DETAILED DESCRIPTION

Figure 1:
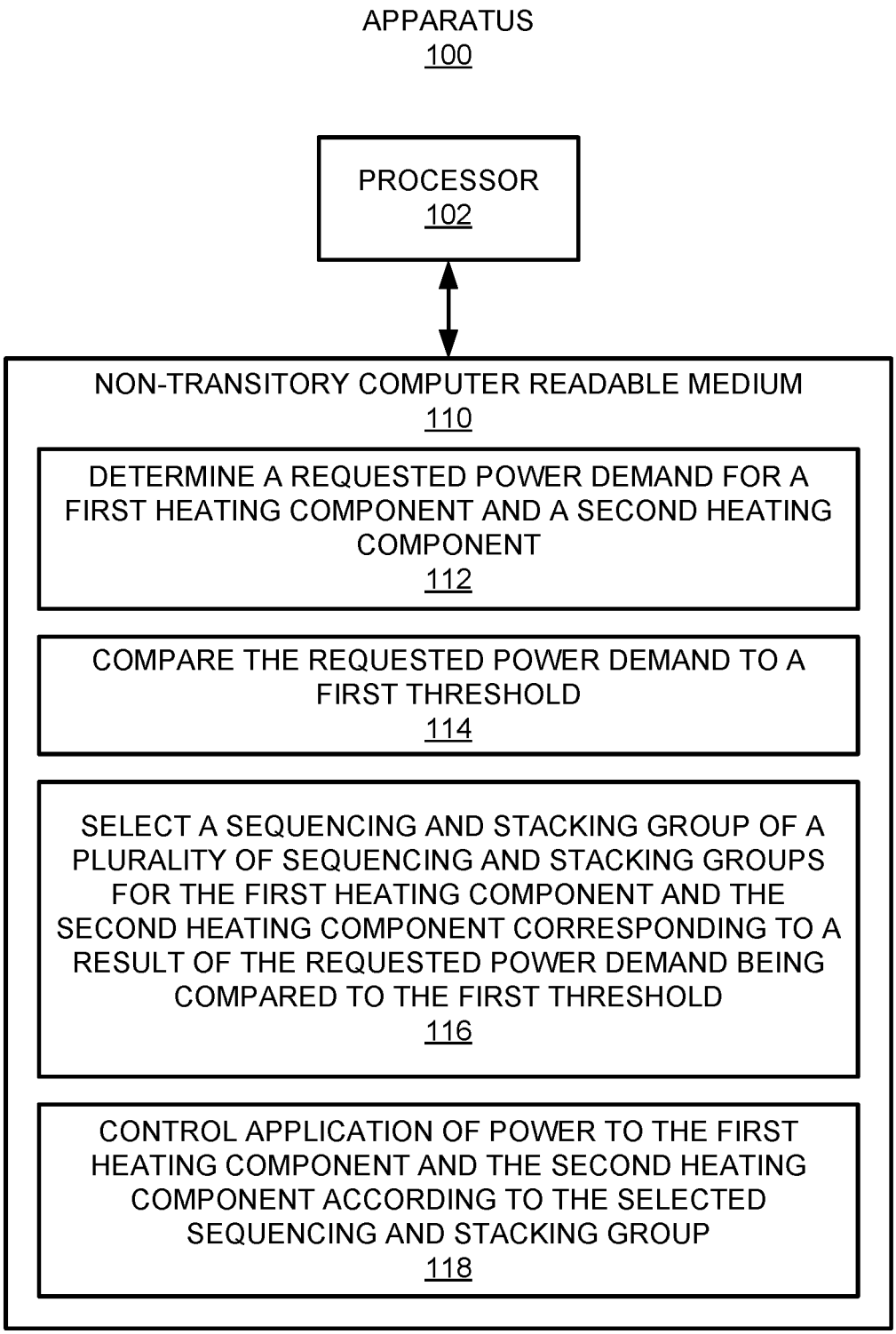
FIG. 1 depicts a block diagram of an example apparatus that may generate control signals for a first heating component and a second heating component to increase temperature in a heated system while smoothing the supply of power to the first and second heating components.

For simplicity and illustrative purposes, the principles of the present disclosure are described by referring mainly to examples thereof. In the following description, numerous specific details are set forth in order to provide an understanding of the examples. It will be apparent, however, to one of ordinary skill in the art, that the examples may be practiced without limitation to these specific details. In some instances, well known methods and/or structures have not been described in detail so as not to unnecessarily obscure the description of the examples. Furthermore, the examples may be used together in various combinations.

Many printers, such as inkjet printers, may include a heated system that may, for example, help reduce media curl and ink smear, and may improve quality in printed output. Heated systems may include resistive heating elements, fusers, pressure rollers, calendaring rollers, etc. Heated systems may include a heat generating device that, when a media is to be conditioned may be supplied with a maximum amount of available power to quickly ramp up the temperature in the heated system to a target temperature. By supplying the maximum amount of available power during the ramp up period, the temperature may be increased to the target temperature in a minimized length of time. Following the ramp up period, the temperature in the heated system may be maintained at or near the target temperature for a duration of a print job, e.g., during a steady-state operation period using a maintenance control signal that may include zero power events interspersed with power application events.

Some heated systems may include various heating components, such as a heating lamp and a resistive heating element or multiple heating lamps and/or multiple resistive heating elements. A heating lamp may have a short thermal time constant, whereas a resistive heating element may have a high thermal-time constant or vice versa and the conditioning mechanisms they are heating may have longer or shorter time constants relative to each other. During the steady-state operation period, power may be applied to the heated system components in periods (or equivalently, cycles). Some or all of the periods may include both high-power events, when maximum cumulative power is applied to the various heating elements, and zero power events during which power is not applied to the heating components. The application of power to the heating components, e.g., heating lamps and the resistive heating elements, may be cycled with the zero power events to maintain the temperatures of conditioning mechanisms in the heated system within respective predefined temperature ranges. That is, continuous application of full power to the heating lamp and/or resistive heating elements during the steady-state power application cycle may cause temperatures in the heated system to be above respective predefined temperature ranges.

However, inclusion of both high power and zero power events during the power application cycles may cause an uneven or choppy delivery of power to the heating components. The uneven or choppy delivery of power may cause flicker, e.g., power-line flicker, to occur. Flicker may be defined as a visible change in brightness of lamps due to rapid fluctuations in the voltage of a power supply. For instance, a voltage drop may be generated over a source impedance of a grid by the changing load current of the heating lamps and/or the resistive heating elements. In a printer, the zero power events may cause flicker in lights that may share the same circuit path as the printer. In addition, or alternatively, the uneven or choppy delivery of the power to the heated system may negatively affect power line harmonics and conducted electro-magnetic compatibility (EMC) emissions.

Disclosed herein are apparatuses, heated systems, methods, and computer readable mediums that may control the application of power to minimize a warmup time of components in a heated system while smoothing the delivery of power to the components in the heated system, e.g., while reducing flicker caused by the application of power to the components. That is, a processor may select a sequencing and stacking group from a plurality of sequencing and stacking groups based on a requested power demand of heating components in a heated system. Each of the plurality of sequencing and stacking groups may include a sequencing and stacking arrangement that may be used to supply power to the components depending upon, for instance, a variance between a detected temperature and a preset temperature. The sequencing and stacking arrangements may be determined through testing and may be defined for each of the sequencing and stacking groups according to, for instance, arrangements that may result in a minimized amount of time used to reach a warmup temperature while smoothing the delivery of power to the components in the heated system. For instance, the arrangements may result in a reduced or minimized flicker caused by the application of power to the heated system components.

According to examples, the processor may compare the requested power demand to thresholds and may select the sequencing and stacking group to be used in supplying power to the heated system components based on which of the thresholds the requested power demand exceeds and which of the thresholds the requested power demand falls below. In addition, the processor may control application of power to the heated system components according to the selected sequencing and stacking group.

According to examples, by reducing flicker caused by the application of power to the heated system components as disclosed herein, the heated system components may pass flicker testing requirements, e.g., may comply with international standards pertaining to flicker testing.

Throughout the present disclosure, the terms "a" and "an" are intended to denote one of a particular element or multiple ones of the particular element. As used herein, the term "includes" means includes but not limited to, the term "including" means including but not limited to. The term "based on" may mean based in part on.

Figure 2A:
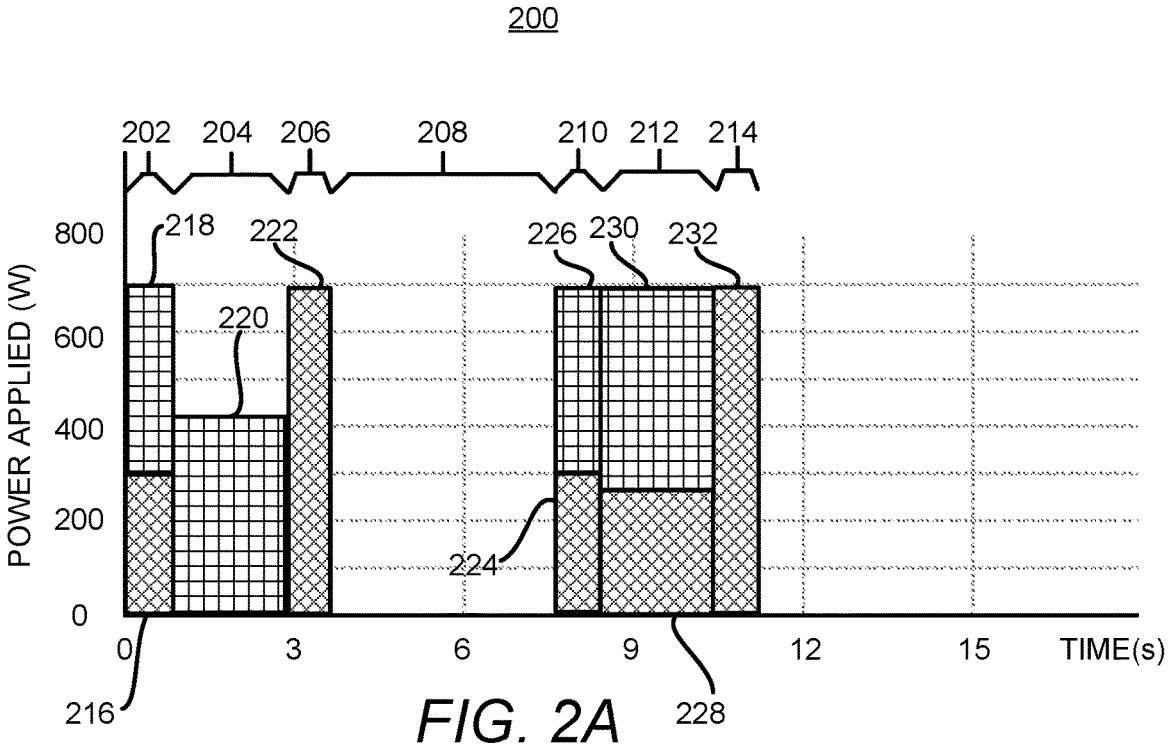
FIGS. 2A and 2B, respectively, show example stacking and sequencing graphs that depict the application of power over time to the first heating component and a second heating component to increase temperature in a heated system while smoothing the delivery of power to the first and second heating components.
Figure 2B:
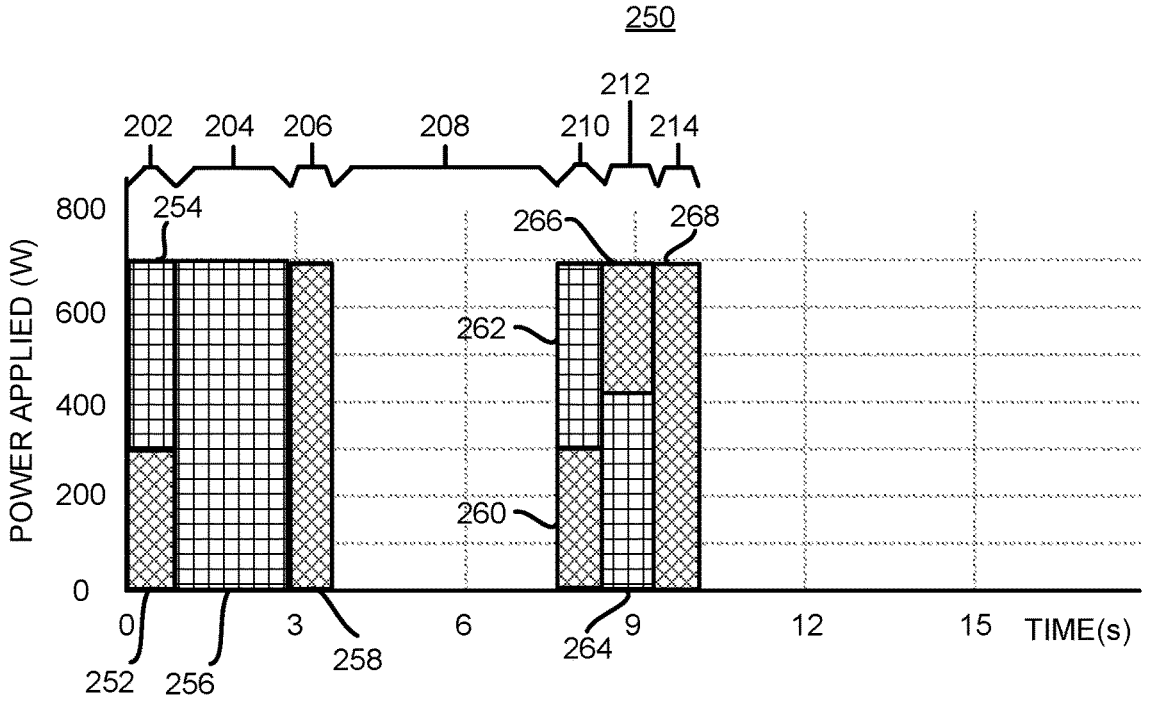

Reference is first made to FIGS. 1, 2A, and 2B. FIG. 1 shows a block diagram of an example apparatus 100 that may generate control signals for a first heating component and a second heating component to increase temperature in a heated system while smoothing power delivery to the first and second heating components. The first heating component may be a heating lamp and the second heating component may be a resistive heating element, although the first heating component and the second heating component may be other types of heating components. FIGS. 2A and 2B, respectively, show example sequencing and control graphs 200, 250 that depict the application of power over time to the first heating component and the second heating component to increase temperature in a heated system while smoothing power delivery. It should be understood that the example apparatus 100 depicted in FIG. 1 and/or the example stacking and sequencing graphs 200, 250 depicted in FIGS. 2A and 2B may include additional features and that some of the features described herein may be removed and/or modified without departing from the scopes of the apparatus 100 and/or the stacking and sequencing graphs 200, 250.

Generally speaking, the apparatus 100 may be a computing apparatus, e.g., a personal computer, a laptop computer, a tablet computer, a smartphone, or the like. In these examples, the apparatus 100 may be separate from a heated system and may communicate instructions to the heated system over a direct or a network connection. In other examples, the apparatus 100 may be part of the heated system. In these examples, the apparatus 100 may be part of a control system of the heated system and may communicate instructions to components of the heated system, for instance, over a communication bus. Examples of the heated system are described in greater detail with respect to FIGS. 3-5 below. Generally speaking, however, the heated system may include the first heating component and the second heating component discussed herein.

As shown in FIG. 1, the apparatus 100 may include a processor 102, which may control operations of the apparatus 100. The processor 102 may be a semiconductor-based microprocessor, a central processing unit (CPU), an application specific integrated circuit (ASIC), a field-programmable gate array (FPGA), graphics processing unit (GPU), a tensor processing unit (TPU), and/or other suitable hardware device. The apparatus 100 may also include a non-transitory computer readable medium 110 that may have stored thereon machine readable instructions 112-118 (which may also be termed computer readable instructions) that the processor 102 may execute. The non-transitory computer readable medium 110 may be an electronic, magnetic, optical, or other physical storage device that contains or stores executable instructions. The non-transitory computer readable medium 110 may be, for example, Random Access memory (RAM), an Electrically Erasable Programmable Read-Only Memory (EEPROM), a storage device, an optical disc, and the like. The term "non-transitory" does not encompass transitory propagating signals.

The processor 102 may fetch, decode, and execute the instructions 112 to determine a requested power demand for a first heating component and a second heating component. In some examples, the first heating component, which may be a heating lamp, and the second heating component, which may be resistive heating element, may be in a ramp up state in which the first heating component and the second heating component may be turned on after an idling period where the heating system is not in use and the heating system drops in temperature to a temperature within some percentage of, and in some examples, as low as, the ambient temperature. In another example, the heating system may be in a maintenance state in which the first heating component and the second heating component may operate to maintain a temperature of or within the heated system within a predefined temperature range.

When in the ramp up state, the first heating component and/or the second heating component may have a higher requested power demand than when in the maintenance state. That is, for instance, prior to or during portions of the ramp up state, the variance between the actual detected temperature in the heated system and a preset, e.g., setpoint, temperature may be relatively larger than the variance between the actual detected temperature and the preset temperature when the heated system is in the maintenance state. Thus, the processor 102 may determine the requested power demand based on the operating condition, e.g., a variance of a detected temperature and a preset temperature of the heated system.

The processor 102 may fetch, decode, and execute the instructions 114 to compare the requested power demand to a first threshold. In examples, the requested power demand may be based on the variance between a current detected temperature and a preset temperature, e.g., the processor 102 may function as a proportional controller. In an example, the first threshold may be based on the maximum power available in an alternating current (AC) source of the heated system. In an example, the maximum power available from an AC source may be determined as a product of the voltage and current supplied by the AC source as may be measured by a detector (not shown). In addition, or in other examples, the requested power demand may be based on a proportional, integral, derivative (PID) control, which may take into account the variance in the current detected temperature and the preset temperature, rate of temperature change is applied, cumulative temperature error, and/or the like. In these examples, the processor 102 may function as a PID controller.

The processor 102 may fetch, decode, and execute the instructions 116 to select a sequencing and stacking group of a plurality of sequencing and stacking groups for the first heating component and the second heating component corresponding to a result of the requested power demand being compared to the first threshold. In an example, the selected sequencing and stacking group may include a particular sequence of activating and deactivating the first heating component and the second heating component to both cause the first heating component and the second heating component to be warmed to a level that causes the heated system to have a certain temperature while smoothing power delivery, e.g., reducing flicker. Also, the selected sequencing and stacking group may include particular timings at which the first heating component and the second heating component are to be activated and/or deactivated. The particular timings may include concurrently activating and/or deactivating the first heating component and the second heating component. The selected sequencing and stacking group may further include the amount of power that is to respectively be supplied to the first heating component and the second heating component during the times at which the first heating component and the second heating component are activated. In addition, each of the plurality of sequencing and stacking groups may include particular sequencing and stacking arrangements.

For instance, FIG. 2A shows an example of a first sequencing and stacking group and FIG. 2B shows an example of a second sequencing and stacking group. The graphs 200 and 250 may show portions of the first sequencing and stacking group and the second sequencing and stacking group. As such, each of the first sequencing and stacking group and the second sequencing and stacking group may include sequencing and stacking arrangements in additional time periods than are shown in FIGS. 2A and 2B. Each of the first sequencing and stacking group shown in the graph 200 (FIG. 2A) and the second sequencing and stacking group shown in the graph 250 (FIG. 2B) may include a plurality of time periods 202-214. As shown, each of the time periods 202-214 may include different durations of time, although the time periods 202-214 may alternatively have the same durations of time.

In the first sequencing and stacking group shown in graph 200 (FIG. 2A), the first heating component may be activated during a first time period 202 as denoted by block 216. In addition, during the first time period 202, the second heating component may be activated as denoted by block 218. As shown, the second heating component may be supplied with a greater amount of power than the first heating component. During the second time period 204, the second heating component may be activated as denoted by block 220. During the third time period 206, the first heating component may be supplied with power as denoted by block 222. During the fourth time period 208, neither one of the first heating component nor the second heating component may be activated. The first heating component and the second heating component may be supplied with power as denoted by blocks 224-232 during the remaining periods 210-214 as shown in FIG. 2A.

In the second sequencing and stacking group shown in graph 250 (FIG. 2B), the first heating component may be activated during a first time period 202 as denoted by block 252 and the second heating component may be activated the first time period 202 as denoted by block 254. In addition, the first heating component and the second heating component may be activated as denoted by blocks 256-268 during the remaining periods 204-214 as shown in FIG. 2B.

The particular sequencing and stacking arrangements included in the plurality of sequencing and stacking groups may be based upon sequencing and stacking arrangements that may result in a smoothing of power delivery, e.g., reduction of flicker, while maintaining detected temperatures within a desired temperature range. According to examples, the particular sequencing and stacking arrangements may be determined through testing of various threshold conditions, e.g., variance thresholds from intended temperatures or error levels. Thus, for instance, particular sequencing and stacking arrangements that may have resulted in a minimized warmup time for the first and second heating components while also smoothing power delivery, e.g., minimizing flicker, caused by the application of power to the first and second heating components for various threshold conditions and/or error levels may be determined through testing. The sequencing and stacking groups may be generated from the determined particular sequencing and stacking arrangements and may be stored with respect to various threshold conditions, e.g., in a lookup table. Generally speaking, the sequencing and stacking group shown in the graph 250 (FIG. 2B) may have a better flicker score than the sequencing and stacking group shown in the graph 200 (FIG. 2A). In some examples, the sequencing and stacking group may be selected to minimize the cumulative fluctuation of power consumed by the first heating component and the second heating component.

By way of example, there may be three temperature variance error levels, e.g., high, medium, and low. That is, when the difference between the actual detected temperature and the intended temperature exceeds a first threshold, the temperature variance level may be high, when the difference exceeds a second threshold and is below the first threshold, the temperature variance level may be medium, and when the difference is below the second threshold, the temperature variance level may be low. In addition, a different pulse width modulation (PWM) for supplying power to the first and second heating components may be assigned for each of the temperature variance levels. For instance, for the high temperature variance level, the PWM may be greater than 80%, for the medium temperature variance level, the PWM may be between 40% and 80%, and for the low temperature variance level, the PWM may be lower than 40%. In other examples, the processor 102 function as a PID controller as discussed herein.

The processor 102 may fetch, decode, and execute the instructions 118 to control application of power to the first heating component and the second heating component according to the selected sequencing and stacking group. The application of power according to the selected sequencing and stacking group may result in a smoothing of power delivery and may also result in a reduction in flicker caused by the application of the power to the first heating component and the second heating component.

Figure 3:
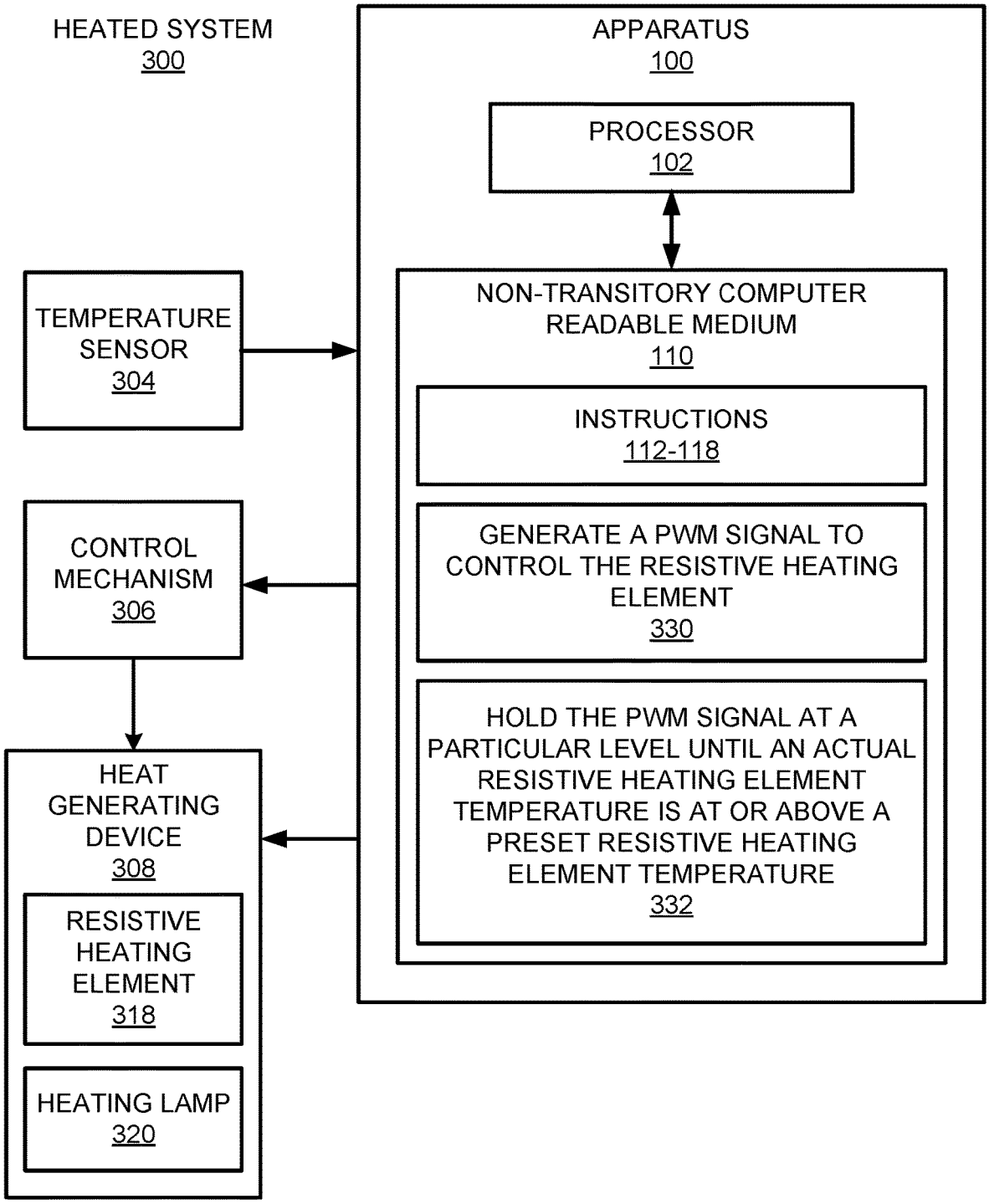
FIG. 3 shows a block diagram of an example heated system that may include the apparatus depicted in FIG. 1, in which the apparatus may control a heat generating device according to a selected sequencing and stacking group.
Figure 4:
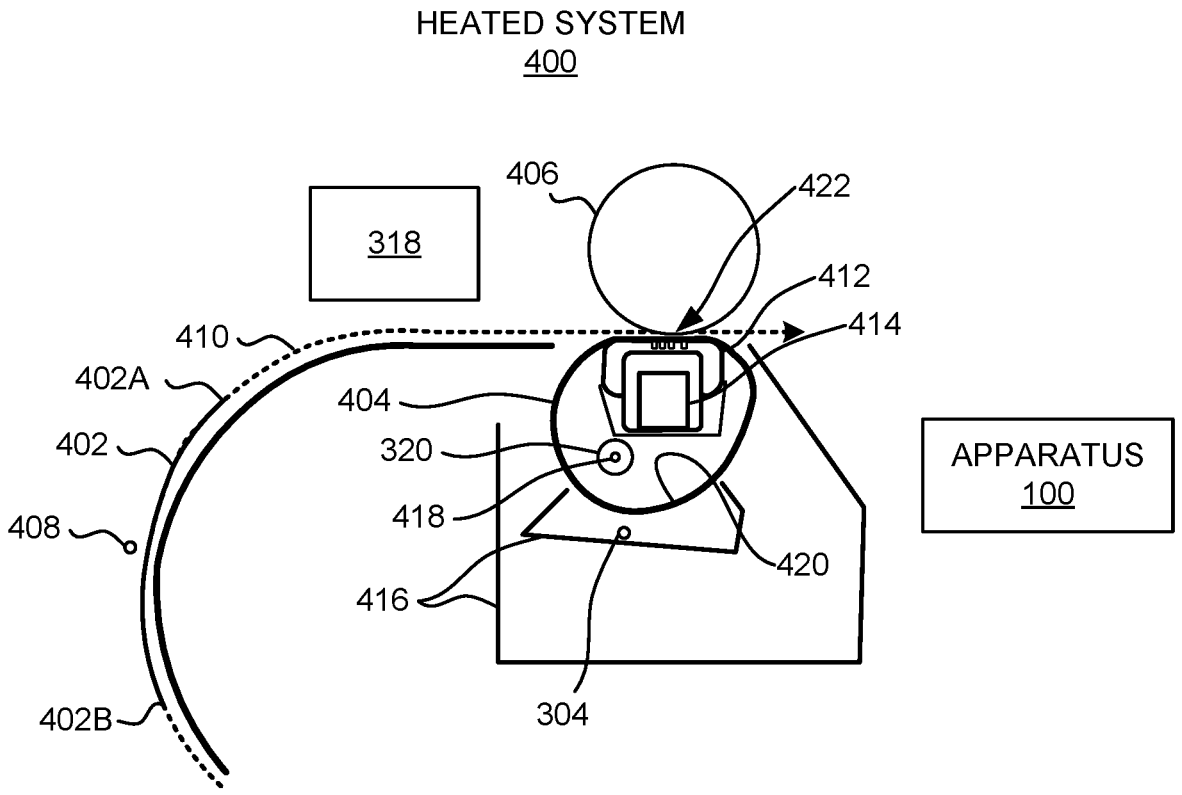
FIG. 4 shows a schematic diagram of an example heated system that may include the apparatus depicted in FIG. 1.

Reference is now made to FIGS. 1-4. FIG. 3 shows a block diagram of an example heated system 300 that may include the apparatus 100 depicted in FIG. 1, in which the apparatus 100 may control a heat generating device 308 according to a selected sequencing and stacking group. FIG. 4 shows a schematic diagram of another example heated system 400 that may include the apparatus 100 depicted in FIG. 1. It should be understood that the example heated system 300 depicted in FIG. 3 and/or the example heated system 400 depicted in FIG. 4 may include additional features and that some of the features described herein may be removed and/or modified without departing from the scopes of the heated system 300 and/or the heated system 400. In addition, it should be understood that either or both of the example heated systems 300 and 400 may have configurations other than the configurations shown in FIGS. 3 and 4.

The heated systems 300, 400 may each be a system in which an object, such as a sheet of media, may be heated. According to examples, the heated system may be part of a media printing system (not shown) in which the heated system may condition, e.g., apply heat, to media upon which a printing medium, e.g., ink, toner, or the like, has been applied. That is, for instance, the heated system may be positioned downstream of a print engine of the media printing system. In other examples, the heated system may be implemented to condition other types of objects, e.g., 3D printed objects, painted objects, or the like.

As shown in FIGS. 3 and 4, the heated systems 300, 400 may include a heat generating device 308, a temperature sensor 304, a control mechanism 306 of the heat generating device 308, and the apparatus 100 depicted in FIG. 1. In addition, the heat generating device 308 may include a resistive heating element 318 (second heating component) and a heating lamp 320 (first heating component). Generally speaking, the apparatus heated by the heating lamp 320 (e.g., conditioning mechanism) may have a short thermal time constant whereas the apparatus heated by the resistive heating element 318 may have a long thermal time constant. In other words, the apparatus associated with the resistive heating element 318 may have a longer thermal time constant than the apparatus associated with the heating lamp 320. This could also be vice versa, such that the apparatus heated by the heating lamp 320 may have a longer time constant than the apparatus heated by the resistive heating element 318.

In examples, the heating lamp 320 and the resistive heating element 318 may heat a sheet of media 402. For instance, the heated systems 300, 400 may include a first conveying component coupled to engage a second conveying component to receive, contact, heat, and convey the sheet of media 402. In this example, the first conveying component may be a heated belt 404 and the second conveying component may be a driven roller, which may be driven to rotate by a motor (not shown). Although not shown, the heat generating device 308 may include a second resistive heating element and a second heating lamp.

The heated system 400 may also include a media sensor 408 disposed along a media path 410, a platen 412, and a platen support structure 414 to support and guide the belt 404, and a chassis 416. In width, the belt 404, roller 406, platen 412 and the platen support structure 414 may extend "into the page" of FIG. 4. The media sensor 408 may sense and generate a signal in response to a sheet of printable media 402 being proximal the media sensor 408. The media 402 may be moving or may be stationary. The sheet of media 402 may be located on the media path 410 within the sensing range of the media sensor 408. The sheet of media 402 may include a leading edge 402A and a trailing edge 402B, named based on the intended direction of travel of the sheet of media 402. The leading edge 402A may be located beyond the media sensor 408, and the trailing edge 402B has not yet reached the media sensor 408. The media sensor 408 may detect the leading edge 402A, the trailing edge 402B, or the body of the sheet of media 402 between the edges 402A, 402B.

The heating lamp 320 may be a radiant heater, which may include a heating element 418. The heating lamp 320 may extend within the belt 404 to heat a heating zone 420 of the belt 404 by thermal radiation. The heating zone 420 may include the portions of the belt 404 that are in the field of view of the heating lamp 320 at any given moment in time. In various examples, the heated system 320 may include multiple heating lamps, which may be designed and arranged to heat different portions of the belt 404. During operation, the roller 406 may conductively be heated by contact with the belt 404, and a length or a piece of media 402, when present, may be heated by contact with the belt 404 and the roller 406. In some examples, the heating lamp 320 may be disposed outside of the belt 404. The heating element 320 may be a halogen-type lamp, but other types of lamps or other types of heating elements may be used to heat the belt 404 and/or the roller 406.

The belt 404 and the roller 406 may contact and press against each other along a nip region 422 to receive and convey the media 402. The nip region 422 may extend along the shared width of the belt 404 and the roller 406. During operation, rotational movement of the roller 406 may drive the belt 404 to rotate by friction or by gearing, with or without media, in between the roller 406 and the belt 404. In addition, the temperature sensor 304 may monitor the temperature of the belt 404 to facilitate control by the processor 102 of the heating lamp 320. The temperature sensor 304 may be a non-contacting thermistor located outside and below the belt 404. Although a single temperature sensor 304 is depicted in FIGS. 3 and 4, additional sensors may be disposed at different locations along the width of the belt 404 as well as at other locations. Other examples may include another form of non-contact temperature sensor or may include a contact temperature sensor located in another appropriate position.

The resistive heating element 318 of the heat generating device 308 may generate heat that may be directed to the sheet of media 402 as the media 402 is fed to further condition the media 402. For instance, the resistive heating element 318 may include a resistive component that may become heated as a current is applied through the resistive component.

The apparatus 100 may control the heating lamp 320 and the resistive heating element 318 via the control mechanism 306 and may receive input from the temperature sensor 304. Particularly, for instance, the apparatus 100 may determine that the heated system 300, 400 is to be implemented to apply heat to an object, for instance, a sheet of media 402. The apparatus 100 may make this determination based on receipt of an instruction from a processor in a printing device, based on receipt of a signal from the media sensor 408, or the like.

Based on the determination, the apparatus 100 may initiate supply of power to the heating lamp 320 for a period of time and may initiate supply of power to the resistive heating element 318 as discussed in detail herein. The apparatus 100 may directly control the supply of power to the heating lamp(s) 320 and/or the resistive heating element(s) 318, e.g., without implementing the control mechanism 306. In addition, although the control mechanism 306 is depicted as being separate from the apparatus 100, in some examples, the control mechanism 306 may be integral with the apparatus 100. That is, for instance, the control mechanism 306 may be a feedback controller that the apparatus 100 may execute or implement. According to examples, the apparatus 100, and more particularly, the processor 102 may control application of power to the resistive heating element 318 and the heating lamp 320 according to a selected sequencing and stacking group as discussed herein to smooth power delivery during application of the power to the resistive heating element 318 and the heating lamp 320.

The non-transitory computer readable medium 110 may have stored thereon machine readable instructions 330-332 in addition to the instructions 112-118 that the processor 102 may execute. The processor 102 may fetch, decode, and execute the instructions 330 to generate a PWM signal to control the resistive heating element 318. The processor 102 may fetch, decode, and execute the instructions 332 to hold the PWM signal at a particular level until an actual resistive heating element 318 or heated apparatus (e.g., conditioning mechanism) is at or above a preset resistive heating element temperature.

Figure 5:
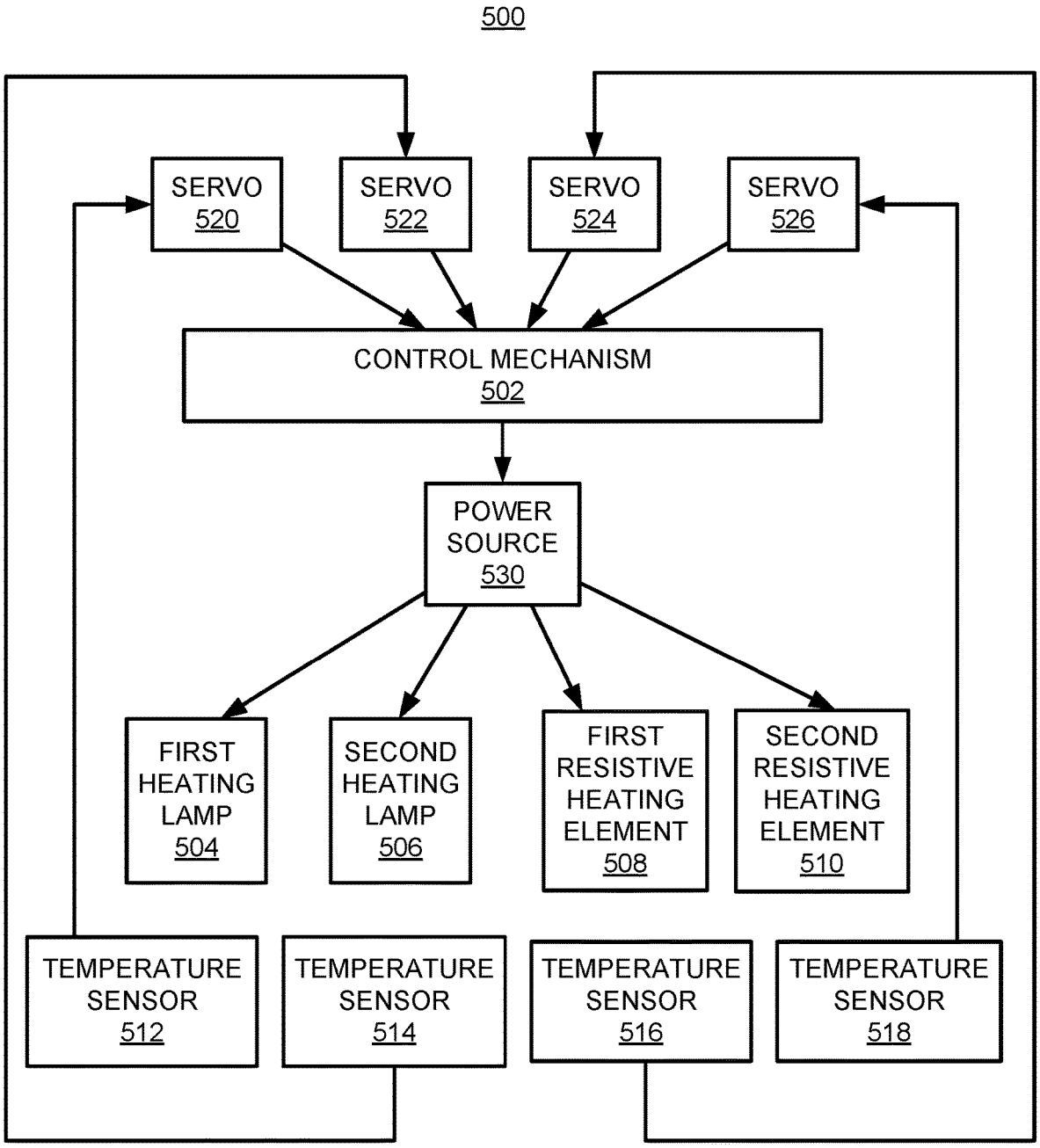
FIG. 5 shows a block diagram of example heated system components that may be included in the heated systems depicted in FIGS. 3 and 4.

Reference is now made to FIGS. 1-5. FIG. 5 shows a block diagram of example heated system components 500 that may be included in the heated systems 300, 400 depicted in FIGS. 3 and 4. It should be understood that the example heated system components 500 depicted in FIG. 5 may include additional features and that some of the features described herein may be removed and/or modified without departing from the scope of the heated system components 500. In addition, it should be understood that the example heated system components 500 may have a configuration other than the configuration shown in FIG. 5.

As shown in FIG. 5, the heated system components 500 may include a control mechanism 502, which may be equivalent to the processor 102, that may control the application of power to a first heating lamp 504, a second heating lamp 506, a first resistive heating element 508, and a second resistive heating element 510. The heated system components 500 may also include temperature sensors 512-518 that may detect temperatures respectively around or near a conditioning mechanism, e.g., belt 404, or several conditioning mechanisms that may be heated solely or by a combination with the first heating lamp, the second heating lamp, the first resistive heating element, and the second resistive heating element. The detected temperatures may be communicated to respective servos 520-526, which may determine corrective feedback based on the received temperatures and may send the corrective feedback information to the control mechanism 502. The control mechanism 502 may control application of power from a power source 530 to the first heating lamp 504, the second heating lamp 506, the first resistive heating element 508, and the second resistive heating element 510 based on the corrective feedback information. For instance, the control mechanism 502 may apply power according to a selected sequencing and stacking group to minimize a warmup time of the heating lamps 504, 506 and the resistive heating elements 508, 510 while smoothing power delivery, e.g., reducing flicker caused by the application of power.

Figure 6:
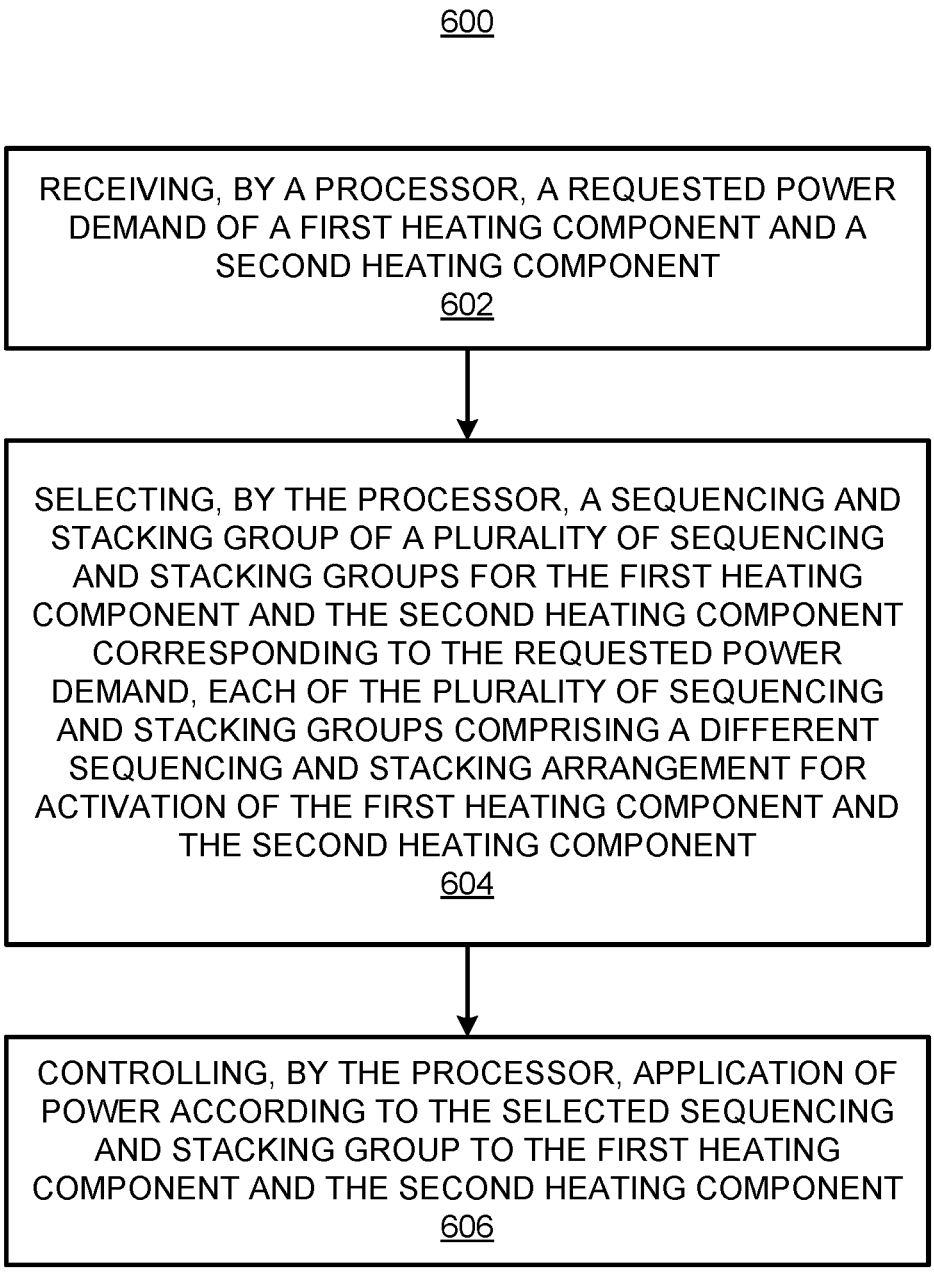
FIGS. 6 and 7, respectively, depict flow diagrams of example methods for selecting a sequencing and stacking group for heating components and controlling application of power to the heating components according to the selected sequencing and stacking group to supply power while smoothing power delivery.
Figure 7:
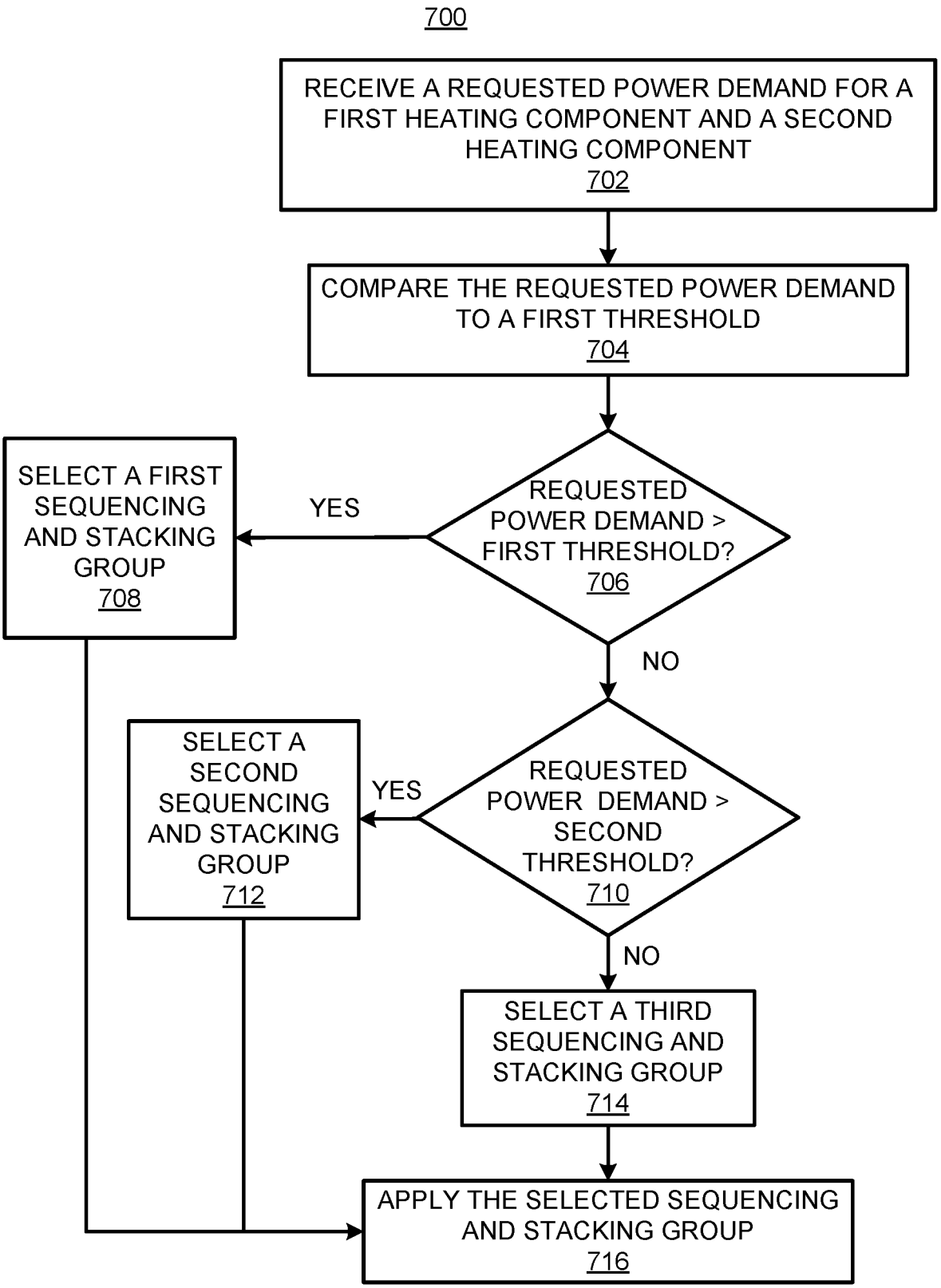

Various manners in which the processor 102 may operate are discussed in greater detail with respect to the methods 600 and 700 respectively depicted in FIGS. 6 and 7. Particularly, FIGS. 6 and 7, respectively, depict flow diagrams of example methods 600 and 700 for selecting a sequencing and stacking group for heating components and controlling application of power to the heating components according to the selected sequencing and stacking group to supply power while smoothing power delivery. It should be understood that the methods 600 and 700 may include additional operations and that some of the operations described herein may be removed and/or modified without departing from the scopes of the methods 600, 700. The descriptions of the methods 600, 700 are made with reference to the features depicted in FIGS. 1-5 for purposes of illustration.

With reference first to FIG. 6, at block 602, the processor 102 may receive a requested power demand of a first heating component (e.g., heating lamp 320) and a second heating component (e.g., a resistive heating element 318). In an example, during the ramp up phase, the heating lamp 320 may request more power to reach a warmup temperature than compared to a maintenance phase. In addition, during the maintenance phase, the heating lamp 320 may request less power than during the ramp up phase to maintain the temperature of the conditioning mechanism (e.g., belt 404) at a desired temperature. According to examples, the processor 102 may receive a requested power demand based on the current condition of the heating components, e.g., a variance in temperature detected by the temperature sensor 304 and a preset temperature, rate of temperature change, and/or cumulative temperature error. For instance, the greater the variance, the greater the requested power demand.

At block 604, the processor 102 may select a sequencing and stacking group of a plurality of sequencing and stacking groups for the first heating component and the second heating component corresponding to the requested power demand, each of the plurality of sequencing and stacking groups including a different sequencing and stacking arrangement for activation of the first heating component and the second heating component. As discussed herein, the processor 102 may select the sequencing and stacking group based upon whether a PWM value exceeds a first threshold, whether the PWM value falls below the first threshold but exceeds a second threshold, or whether the PWM value falls below the second threshold. Based on the PWM value exceeding the first threshold, as may occur during a ramp up phase of the heated system 300, 400, the processor 102 may select the sequencing and stacking group that may cause delivery of a predefined maximum power to the second heating component. However, based on the PWM value falling below the first threshold but exceeding a second threshold, as may occur during a maintenance phase of the heated system 300, 400, the processor 102 may select the sequencing and stacking group that may cause delivery of a predefined minimum power to the second heating component. As discussed above, the selected sequencing and stacking group may result in a smoothing of power delivery, which may also result in a reduction or minimization of flicker caused by the application of power to the first and second heating components.

At block 606, the processor 102 may control application of power according to the selected sequencing and stacking group to the first heating component and the second heating component to, for instance, minimize warmup time of the first and second heating components while smoothing power delivery, e.g., reducing flicker.

In an example, the processor 102 may determine the sequencing and stacking group based on the thermoelectrical coefficient of the first heating component and/or the thermoelectrical coefficient of the second heating component. For example, the heating lamp 320, during the ramp up phase, may call for or use less power when the internal resistance of the heating lamp 320 is low and more power as the internal resistance of the heating lamp 320 stabilizes.

In an example, the processor 102 may determine the sequencing and stacking group based on the first page out time. In an example, the processor 102 may determine the sequencing and stacking group based on the maximum power level of a power source available for the first heating component and the second heating component.

Turning now to FIG. 7, at block 702, the processor 102 may receive a requested power demand for the heating lamp 320 (first heating component) and the resistive heating element 318 (second heating component).

At block 704, the processor 102 may compare the requested power demand to a first threshold. As discussed herein, the first threshold may be based on a temperature variance between an actual detected temperature and a desired temperature or a PWM value from a PID controller. At block 706, the processor 102 may determine whether the requested power demand is greater than the first threshold. Based on a determination that the requested power demand is greater than the first threshold, at block 708, the processor 102 may select a first sequencing and stacking group of a plurality of sequencing and stacking groups. However, based on a determination that the requested power demand is less than the first threshold, at block 710, the processor 102 may determine whether the requested power demand is greater than a second threshold. Based on a determination that the requested power demand is greater than the second threshold, the processor 102 may select, at block 712, a second sequencing and stacking group of the plurality of sequencing and stacking groups.

However, based on the determination at block 710 that the requested power demand is less than the second threshold, at block 714, the processor 102 may select a third sequencing and stacking group of the plurality of sequencing and stacking groups. At block 716, the processor 102 may apply the selected one of the first, second, or third sequencing and stacking group.

Some or all of the operations set forth in the methods 600 and 700 may be included as utilities, programs, or subprograms, in any desired computer accessible medium. In addition, the methods 600 and 700 may be embodied by computer programs, which may exist in a variety of forms both active and inactive. For example, they may exist as machine readable instructions, including source code, object code, executable code or other formats. Any of the above may be embodied on a non-transitory computer readable storage medium.

Examples of non-transitory computer readable storage media include computer system RAM, ROM, EPROM, EEPROM, and magnetic or optical disks or tapes. It is, therefore, to be understood that any electronic device capable of executing the above-described functions may perform those functions enumerated above.

Figure 8:
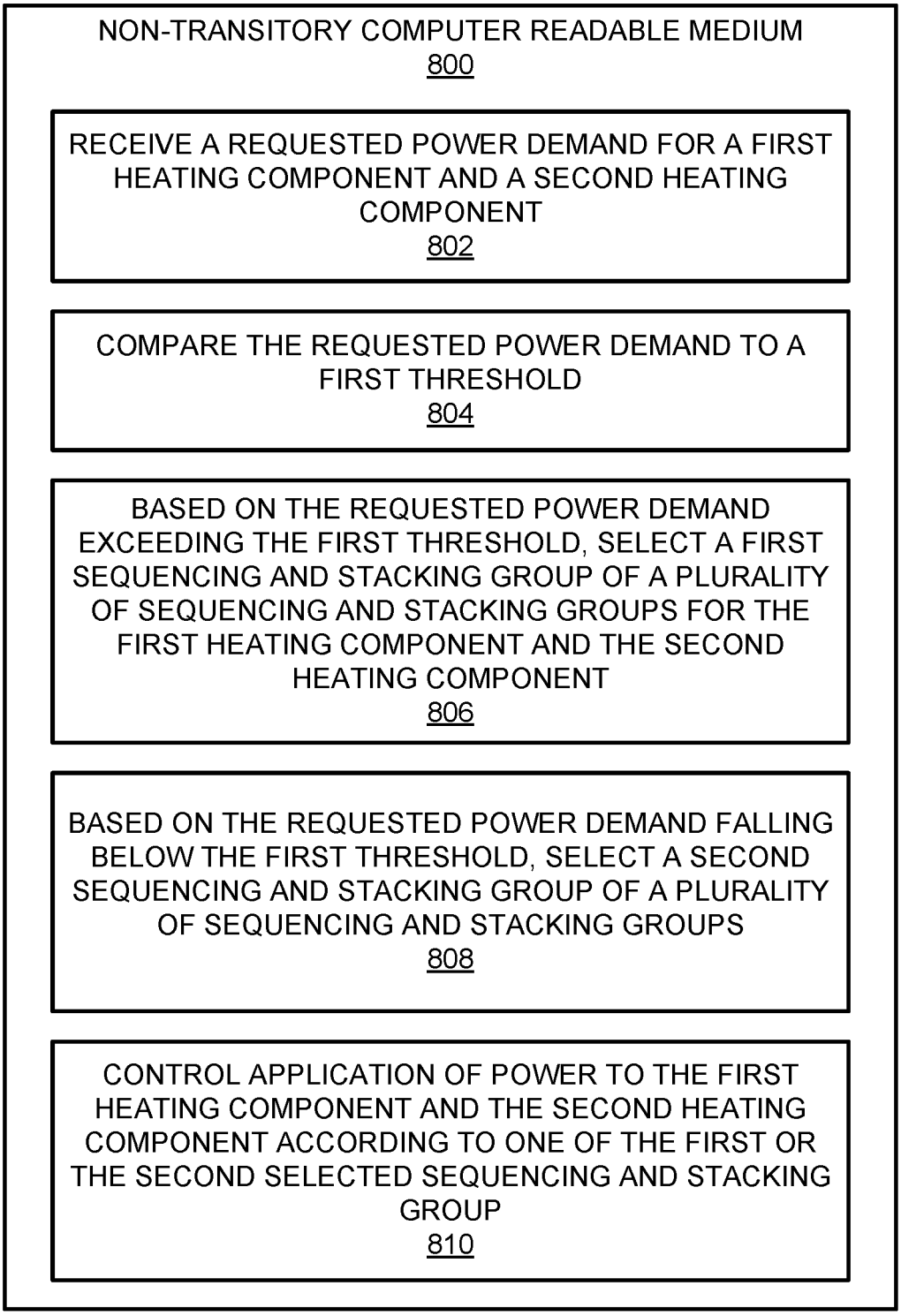
FIG. 8 shows an example non-transitory computer readable medium for selecting a sequencing and stacking group for heating components and controlling application of power to the heating components according to the selected sequencing and stacking group to supply power while smoothing power delivery.

Turning now to FIG. 8, there is shown an example non-transitory computer readable medium 800 for selecting a sequencing and stacking group for heating components and controlling application of power to the heating components according to the selected sequencing and stacking group to supply power while smoothing power delivery. The non-transitory computer readable medium 800 may be an electronic, magnetic, optical, or other physical storage device that contains or stores executable instructions. The computer readable medium 800 may be, for example, Random Access memory (RAM), an Electrically Erasable Programmable Read-Only Memory (EEPROM), a storage device, an optical disc, and the like.

The non-transitory computer readable storage medium 800 may have stored thereon machine readable instructions 802-810 that a processor, e.g., the processor 102, may execute. The machine readable instructions 802 may cause the processor 102 to, receive a requested power demand for a heating lamp 320 (first heating component) and the resistive heating element 318 (second heating component). The machine readable instructions 804 may cause the processor 102 to compare the requested power demand to a first threshold. The machine readable instructions 806 may cause the processor 102 to, based on the requested power demand exceeding the first threshold, select a first sequencing and stacking group of a plurality of sequencing and stacking groups for the resistive heating element 318 and the heating lamp 320.

The machine readable instructions 808 may cause the processor 102 to, based on the requested power demand falling below the first threshold, select a second sequencing and stacking group of a plurality of sequencing and stacking groups for the resistive heating element 318 and the heating lamp 320. The machine readable instructions 810 may cause the processor 102 to control application of power to the resistive heating element 320 and the heating lamp 318 according to one of the first or the second selected sequencing and stacking group to smooth power delivery. In some examples, the non-transitory computer readable medium 800 may include additional instructions that may cause the processor 102 to generate a PWM signal to control the heating lamp 320 and the resistive heating element 318. For example, the processor 102 may generate a PWM signal to control the heating lamp 320 and the resistive heating element 318 according to the selected sequencing and stacking group.

Although described specifically throughout the entirety of the instant disclosure, representative examples of the present disclosure have utility over a wide range of applications, and the above discussion is not intended and should not be construed to be limiting but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. An apparatus comprising:

a processor; and a non-transitory computer readable medium storing machine readable instructions that when executed by the processor, cause the processor to:

determine a requested power demand for a first heating component and a second heating component;

compare the requested power demand to a first threshold;

select a sequencing and stacking group from a plurality of sequencing and stacking groups for the first heating component and the second heating component corresponding to a result of the requested power demand being compared to the first threshold, wherein the first heating component is positioned in the apparatus to heat a belt that is to heat sheets of media and the second heating component is positioned in the apparatus to heat the sheets of media directly, and wherein each of the plurality of sequencing and stacking groups includes a first particular sequence of multiple activations and deactivations of the first heating component over certain time periods and a second particular sequence of multiple activations and deactivations of the second heating component over the certain time periods to smooth delivery of power to the first heating component and the second heating component over the certain time periods; and control application of power to the first heating component and the second heating component according to the selected sequencing and stacking group.

2. The apparatus of claim 1, wherein the selected sequencing and stacking group comprises a first time period, a second time period, and a third time period, wherein the first time period includes a first sequence and stacking arrangement, the second time period includes a second sequence and stacking arrangement, and the third time period includes a third sequence and stacking arrangement.

3. The apparatus of claim 1, wherein the second heating component is a resistive heating element and wherein the selected sequencing and stacking group is to cause delivery of a predefined maximum power to the resistive heating element based on the requested power demand being above the first threshold.

4. The apparatus of claim 1, wherein the second heating component is a resistive heating element and wherein the selected sequencing and stacking group is to cause delivery of a predefined minimum power level to the resistive heating element based on the requested power demand being below a second threshold.

5. The apparatus of claim 1, wherein the second heating component is a resistive heating element and wherein the selected sequencing and stacking group is to cause delivery of a predefined medium power to the resistive heating element based on the power demand being between the first threshold and a second threshold.

6. The apparatus of claim 1, wherein the first heating component is a heating lamp and the second heating component is a resistive heating element and wherein the selected sequencing and stacking group is based on a thermoelectrical coefficient of the heating lamp, a thermoelectrical coefficient of the resistive heating element, or both.

7. The apparatus of claim 1, wherein the selected sequencing and stacking group is based on a first page out time.

8. The apparatus of claim 1, wherein the first heating component is a heating lamp and the second heating component is a resistive heating element and wherein the selected sequencing and stacking group is based on a maximum power level of a power source for the resistive heating element and the heating lamp.

9. The apparatus of claim 1, wherein the first heating component is a heating lamp and the second heating component is a resistive heating element and wherein the instructions are further to cause the processor to generate a pulse width modulation (PWM) signal to control the resistive heating element and hold the PWM signal at a particular level until a detected resistive heating element temperature is at or above a preset resistive heating element temperature.

10. A method comprising:

receiving, by a processor, a requested power demand of a first heating component and a second heating component, wherein the second heating component is a resistive heating element;

selecting, by the processor, a sequencing and stacking group of a plurality of sequencing and stacking groups for the first heating component and the second heating component corresponding to the requested power demand, each of the plurality of sequencing and stacking groups comprising a different sequencing and stacking arrangement for separate activation of the first heating component and the second heating component, wherein the selected sequencing and stacking group is to cause delivery of a predefined minimum power to the resistive heating element based on the requested power demand being below a second threshold; and controlling, by the processor, application of power according to the selected sequencing and stacking group to the first heating component and the second heating component.

11. The method of claim 10, wherein the selected sequencing and stacking group comprises a first time period, a second time period, and a third time period, wherein the first time period includes a first sequence and stacking arrangement, the second time period includes a second sequence and stacking arrangement, and the third time period includes a third sequence and stacking arrangement.

12. The method of claim 10, wherein the second heating component is a resistive heating element and wherein the selected sequencing and stacking group is to cause delivery of a predefined maximum power to the resistive heating element based on the power demand being above a first threshold.

13. A non-transitory computer-readable medium comprising machine readable instructions that when executed by a processor cause the processor to:

receive a requested power demand for a heating lamp and a resistive heating element;

compare the requested power demand to a first threshold;

based on the requested power demand exceeding the first threshold, select a first sequencing and stacking group of a plurality of sequencing and stacking groups for the heating lamp and the resistive heating element;

based on the requested power demand falling below the first threshold, select a second sequencing and stacking group of the plurality of sequencing and stacking groups; and generate a pulse width modulation (PWM) control signal to control application of power to the heating lamp and the resistive heating element according to one of the first or the second selected sequencing and stacking group.

* * * * *